United States Patent [19]

Pottier

[11] Patent Number: 4,596,946

[45] Date of Patent: Jun. 24, 1986

[54] LINEAR CHARGED PARTICLE ACCELERATOR

[75] Inventor: Jacques Pottier, Orsay, France

[73] Assignee: Commissariat a l'Energie Atomique, Paris, France

[21] Appl. No.: 495,812

[22] Filed: May 18, 1983

[30] Foreign Application Priority Data

May 19, 1982 [FR] France ..... 82 08786

[51] Int. Cl.[4] ..... H01J 25/10

[52] U.S. Cl. ..... 315/5.41; 315/5.42; 315/5.51; 315/5.52; 328/233

[58] Field of Search ..... 315/5.41, 5.42, 5.51, 315/5.52; 328/233; 313/359.1

[56] References Cited

U.S. PATENT DOCUMENTS

| | | | |
|---|---|---|---|
| 2,770,755 | 11/1956 | Good | 315/5.51 X |
| 2,785,335 | 3/1957 | Dicke | 315/5.51 X |
| 3,067,359 | 12/1962 | Pottier | 315/5.51 X |
| 4,181,894 | 1/1980 | Pottier | 315/5.41 |
| 4,211,954 | 7/1980 | Swenson | 315/5.41 |
| 4,284,923 | 8/1981 | Pottier | 315/5.51 |
| 4,404,495 | 9/1983 | Muller | 315/5.41 |

FOREIGN PATENT DOCUMENTS

| | | | |
|---|---|---|---|
| 0178915 | 12/1968 | U.S.S.R. | 315/5.42 |

*Primary Examiner*—Saxfield Chatmon
*Attorney, Agent, or Firm*—Handal & Morofsky

[57] ABSTRACT

A linear charged particle accelerator incorporating drift tubes is disclosed. The linear charged particle accelerator is of the type comprising, within a conductive envelope, drift tubes defining between them acceleration gaps of lengths such that in two successive gaps the longitudinal component of the electrical field has an identical modulus having in each gap, a supplementary drift tube arranged substantially in the center of the gap between two adjacent tubes and electrically connected to the envelope by an impedence, the addition of the supplementary drift tubes making it possible to reduce the diameter of the drift tubes and increase the effective linear shunt impedence of the accelerator structure.

6 Claims, 9 Drawing Figures

FIG. 4
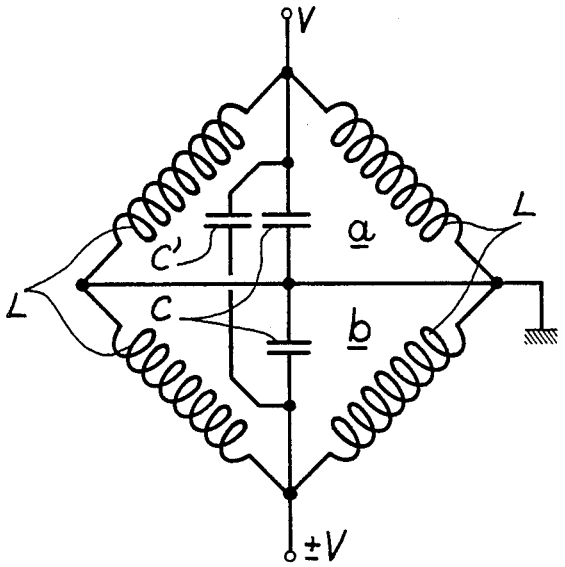
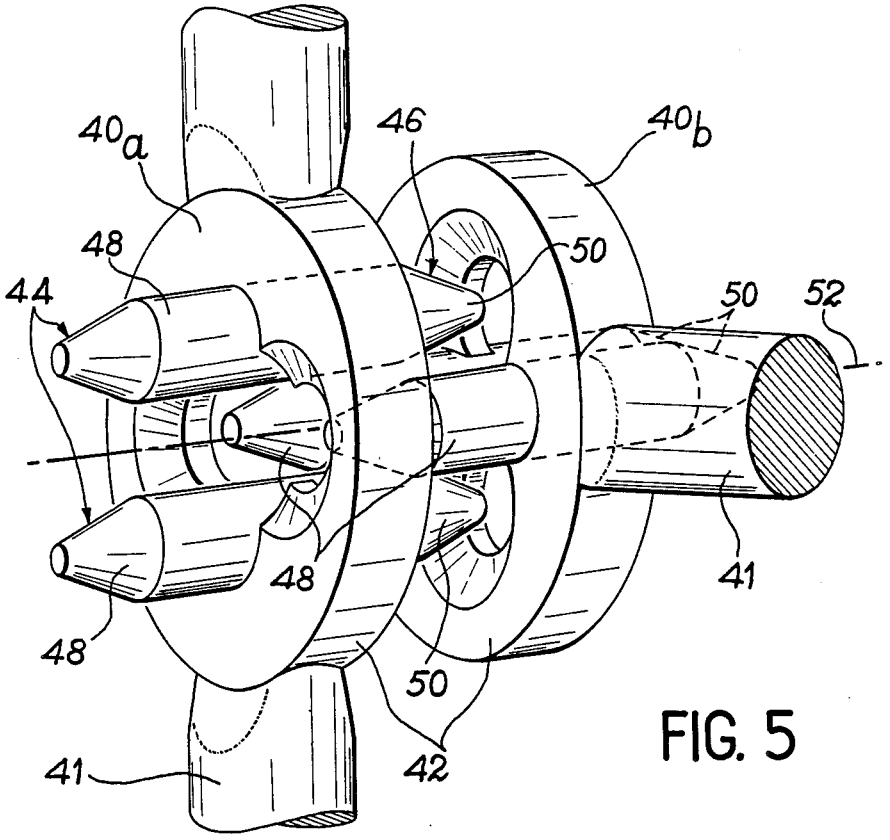
FIG. 5

LINEAR CHARGED PARTICLE ACCELERATOR

BACKGROUND OF THE INVENTION

The present invention relates to a linear charged particle and in particular ion accelerators, comprising drift tubes. This accelerator which can in particular accelerate two types of ions having different masses, can be used in the production of radioactive elements for medical use, in the construction of ion probes, in isotopic dating and in the construction of high energy ion implanters.

FIG. 1 shows in exemplified manner the circuit diagram of a standing wave linear accelerator having Wideroe-type drift tubes. This accelerator comprises a generally cylindrical cavity 1, in which are arranged along axis 2 thereof, tubes 4 and 6, which are currently called drift tubes, which define between them gaps I. These tubes 4, 6 are alternately connected to the two terminals of a high frequency generator 8. The ions, injected by a source 10, are accelerated in gaps I by the high frequency electrical field prevailing therein.

It is known that accelerating structures or linear accelerators with drift tubes cannot be used with advantage for accelerating ions whose charge q/mass A ratio varies only slightly from the optimum value for which they were designed.

Thus, in such devices having a certain number of drift tubes, the law of particle velocity is imposed. The electrical field necessary for accelerating the ions is consequently inversely proportional to the q/A ratio. A device designed for accelerating particles of ratio $(q/A)_o$, with the maximum electrical field will be unable to accelerate particles such that q/A is below $(q/A)_o$ and particles for which q/A exceeds $(q/A)_o$ cannot be accelerated to an energy per nucleon which significantly exceeds that obtained with the particles of ratio $(q/A)_o$.

The different methods proposed for obviating this problem, such as regulating the frequency of the electrical field, modifying the position of the drift tubes, etc. have the disadvantage of considerably complicating the technological construction of the accelerating structures and of consequently making them less reliable and more expensive.

In the aforementioned standing wave accelerating structures, it is also known that the spatial period L of the structure (length of a tube, plus length of a gap) is proportional to the wavelength in vacuum $\lambda$, associated with the electrical field, and with the ratio $\beta$ of the velocity of the ions to that of light. More specifically, in Wideroe accelerators, such as are diagrammatically shown in FIG. 1, the spatial length L is governed by the equation $L=\beta\lambda/2$. In the same way, the external diameter of the drift tubes is proportional to the wavelength $\lambda$ and the ratio $\beta$.

To ensure that the mean value of the electrical field is not too low, compared with its peak value, it is virtually necessary to choose for the length of the acceleration gaps I, a value close to that of the drift tubes, i.e. close to $\beta\lambda/4$ in the case of the Wideroe type.

Moreover, to ensure that the electrical field is sufficiently homogeneous in the acceleration gaps I, the external diameter of the tubes must not be too small compared with the length of the acceleration gaps. Generally this diameter has a value close to that of the length of a gap I, i.e. is more than half $\beta\lambda/2$ and close to $\beta\lambda/4$.

Thus, for high values of (above about 0.15), it is necessary to have drift tubes with an unnecessarily large diameter compared with that necessary for the passage of the beam.

The capacitive load of the drift tubes consequently becomes very high. The currents circulating in the walls of these tubes are then intense and lead to a prohibitive energy dissipation. Thus, the effective linear shunt impedance Z of these structures, defined by the equation $Z=\overline{E}^2/P_1$, $\overline{E}$ being the mean value of the electrical field and $P_1$ the power dissipated by unit of length, becomes much too low.

BRIEF SUMMARY OF THE INVENTION

The present invention relates to a linear charged particle accelerator comprising drift tubes, which makes it possible to obviate the disadvantages referred to hereinbefore. In particular it makes it possible reduction of the diameter of the drift tubes and increase of the effective linear shunt impedance of the structure of the ion accelerators. In the case of Wideroe-type accelerators, it also makes it possible to accelerate two types of ions having different masses.

More specifically the invention relates to a linear charged particle accelerator of the type comprising, within a conductive envelope, drift tubes defining between them acceleration gaps of lengths such that in two successive gaps the longitudinal component of the electrical field has an identical modulus, having, in each gap, a supplementary drift tube arranged substantially in the centre of the gap between two adjacent tubes and electrically connected to the envelope by an impedance, the addition of the supplementary drift tubes making it possible to reduce the diameter of the drift tubes and increase the effective linear shunt impedance of the accelerator structure.

In the case of a Wideroe linear charged particle accelerator, the aforementioned structure can be used to enable this type of accelerator to operate, as required on two different loads, one being fast and suitable for a first type of ion, the other slow and suitable for a second heavier type of ion.

The invention also relates to a linear accelerator, wherein the supplementary drift tubes are connected to earth, one out of two of the other drift tubes being connected to an instantaneous potential source V, the next being connected to an instantaneous potential source V' of the same sign, or to an instantaneous potential source −V' of the opposite sign.

According to a first embodiment of a Wideroe linear accelerator according to the invention, the length of all the drift tubes is equal to the length of the gap separating a supplementary drift tube from another drift tube.

According to a second embodiment of the Wideroe linear accelerator according to the invention, the supplementary drift tubes have a length which is less than the length of the gap separating a supplementary drift tube and another drift tube, whilst the other drift tubes have a length greater than the length of the gap.

The aforementioned accelerator can be advantageously used, when the latter has an input stage using the focusing of an ion beam by quadripole at high frequency.

According to the invention, all the drift tubes of the input stage comprise a central ring on which are mounted, parallel to the ring axis, two pairs of two half-fingers disposed on either side of the ring, the half-fingers of each set being arranged symmetrically with respect to the ring axis, the half-fingers of two sets being displaced from one another by an angle $\pi/2$ for every other drift tube, and positioned in the extension of one another for the other drift tubes.

BRIEF DESCRIPTION OF THE DRAWINGS

The invention is described in greater detail hereinafter relative to non-limitative embodiments and the attached drawings, wherein show.

FIGS. *2a–b* are a circuit diagram of a linear ion accelerator according to the invention.

FIGS. *3a–b* are in longitudinal sectional form, an embodiment of a linear accelerator according to the invention, FIG. *3a* being a section along the plates carrying the drift tubes raised to potentials V and ±V and FIG. *3b* a section along the plate carrying the drift tubes raised to earth potential.

FIG. 4 is an electrical diagram corresponding to the linear accelerator of FIGS. *3a* and *3b*.

FIG. 5 is a prior art high frequency quadripole drift tubes.

Figure 6:
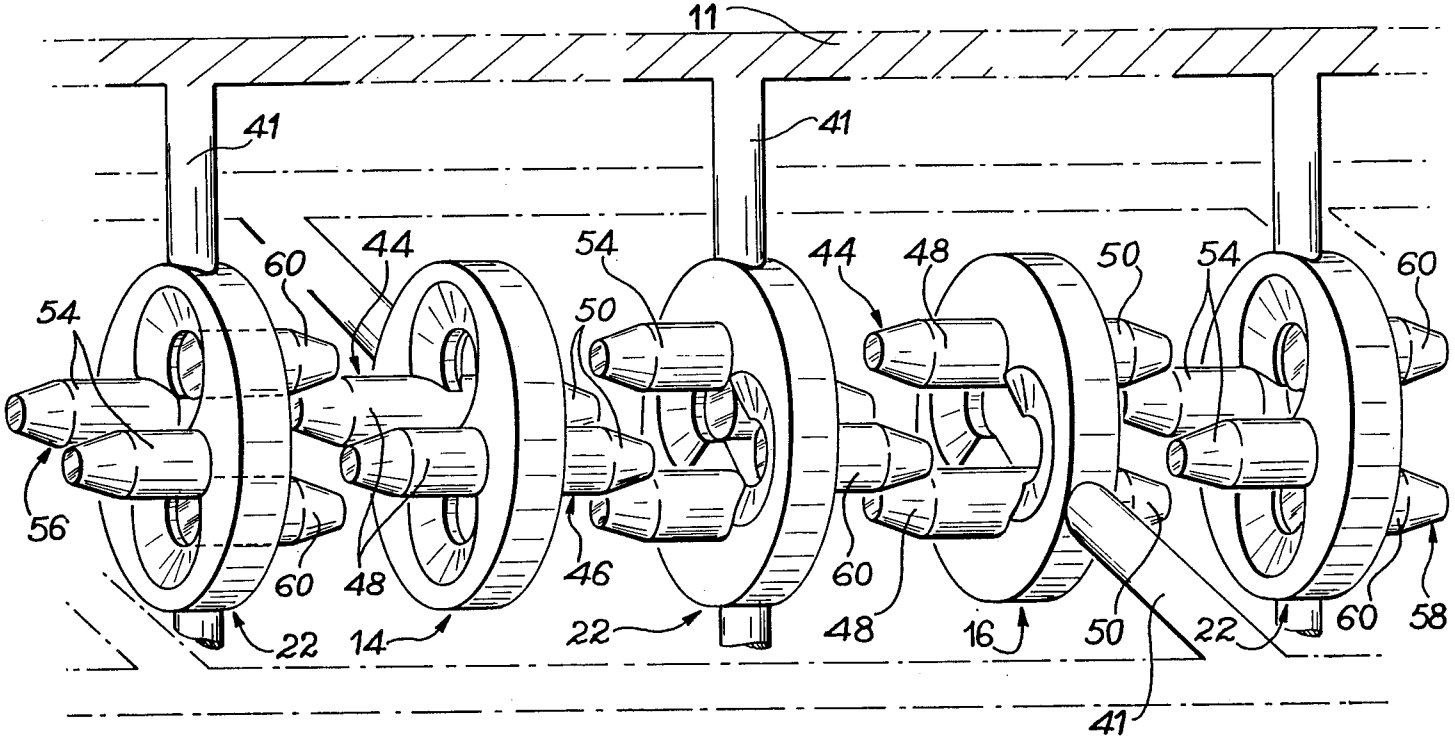

FIG. 6 illustrates high frequency quadripole drift tubes according to the invention.

Figure 7:
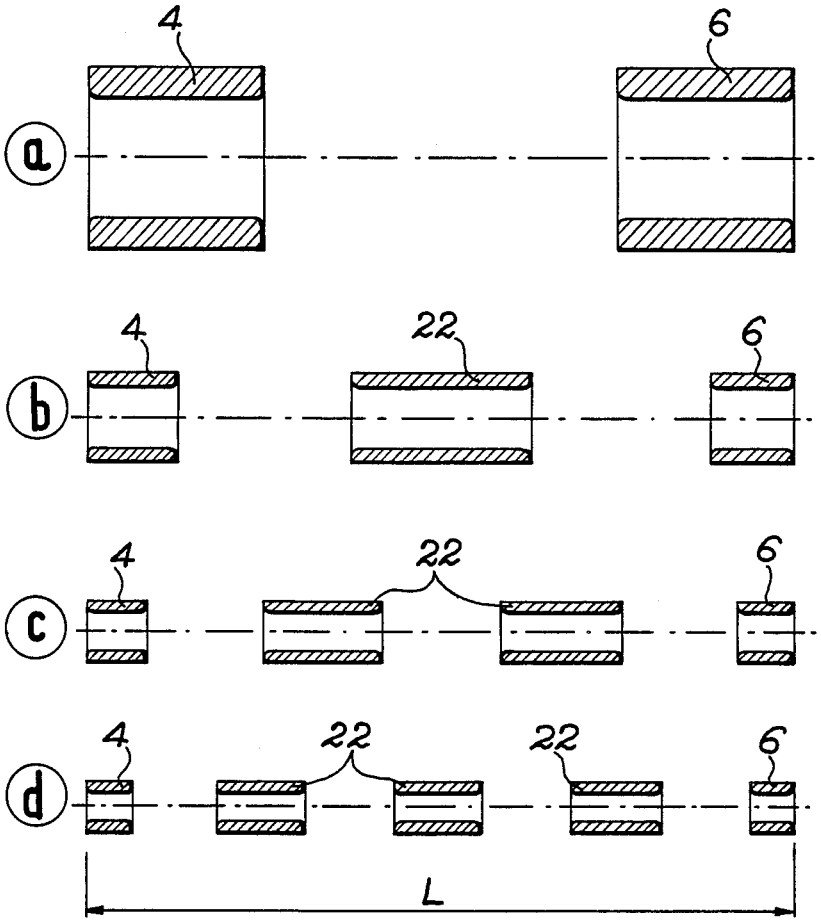

FIG. 7 diagrammatically shows in a, b, c and d linear accelerators in which (a) represents a prior art accelerator, having a single acceleration gap between two half-drift tubes, (b) shows an accelerator according to the invention having a supplementary drift tube subdividing the acceleration gap into two half-cells, (c) shows an accelerator according to the invention having two supplementary drift tubes and (d) shows an accelerator according to the invention having three supplementary drift tubes.

DETAILED DESCRIPTION OF THE PREFERRED EMBODIMENTS

FIGS. *2a* and *2b* show the principle of a linear charged particle and in particular ion accelerator according to the invention. As in the prior art accelerators, this accelerator comprises a generally cylindrical cavity 11 in which are alternately disposed along the cavity axis 12, drift tubes 14 and 16 defining between them acceleration gaps. The tubes 14 are connected to a first alternating high frequency source 18, supplying a first potential $V_1$ and the tubes 16 are connected to a second alternating high frequency source 19 supplying a second potential $V_2$. The ions to be accelerated are injected into the accelerator by means of an injector 20.

According to the invention, the linear accelerator also comprises supplementary drift tubes 22, arranged in the centre of the gaps, separating tubes 16 and tubes 14. The supplementary tubes 22 are raised to a potential $V_3$, which differs very considerably from potentials $V_1$ and $V_2$. For example, potential $V_1$ can have a value V and potential $V_2$ a value close to ±V, whilst potential $V_3$ can be earth potential, as shown in FIGS. *2a* and *2b*.

The presence of these supplementary drift tubes 22 makes it possible to double the number of acceleration gaps, as well as that of the drift tubes. This makes it possible to reduce the external diameter of the drift tubes by approximately a factor of 2 and consequently reduce the capacitive load of these tubes.

The reduction of this capacitive load leads to a lower energy dissipation than in the prior art devices, leading to an increase in the effective linear shunt impedance of the linear accelerator. Tests have shown that this shunt impedance is multiplied by a factor of approximately 2 or 3.

In the application to a Wideroe linear charged particle accelerator, the drift tubes 14 are raised to alternating potentials close to V and drift tubes 16 either to alternating potentials close to V, or to alternating potentials close to −V. The supplementary drift tubes 22 then being raised to earth potential.

The fact that the drift tubes 16 are raised either to alternating potentials close to V, or to alternating potentials close to −V, enables the linear accelerator to operate on two different modes, in view of the fact that the spatial period of the high frequency electric field prevailing in gaps I′ between drift tubes 14 or 16 and supplementary drift tubes 22, is twice as high in the second case (−V) as in the first case (V), and more particularly with respect to the first harmonic of this field. Thus, when the period of the electrical field is the same in both cases, a synchronous particle must travel twice as fast in the second case as in the first.

The first embodiment, called the slow mode and which corresponds to a conventional operation type, makes it possible to accelerate a first type of ion, whilst the second mode, called the fast mode, makes it possible to accelerate a second type of ion, which is lighter than the first.

According to a special embodiment of the linear accelerator according to the invention, all the slide tubes have, in the manner shown in FIG. *2a*, a length l equal to the length g of a gap I′, separating drift tubes 14 or 16 from supplementary tubes 22. In such a construction, length l and length g are governed by the equation $l=g=\beta_L\lambda/4$ in which $\lambda$ is the wavelength in vacuum and $\beta_L$ the ratio of the velocity of the ions to that of light, when operating in the slow mode.

Whilst assuming the electrical field to be homogeneous in the acceleration gaps I′, simple calculations show that in this case the efficiency $\eta$ of the fast mode compared with the slow mode is close to 0.76, or in other words the energy acquired by a particle is an acceleration gap I′, for the same potential value V, is 0.76 times lower in the fast mode than in the slow mode.

In order to improve the operation of the linear accelerator in the fast mode, according to the invention it is possible to use unequal drift tubes, whilst still maintaining acceleration gaps I′ of identical lengths g, i.e. such that $g=\beta_L\lambda/4$. This is shown in FIG. *2b*. In particular the supplementary drift tubes 22 have a length $l_m$, which is less than the length g of a gap I′, separating a drift tube 14 or 16 from a supplementary drift tube 22, whilst the drift tubes 14 and 16 have a length $l_n$, which is greater than the length g of a gap I′.

For example, when the length $l_m$ is taken as equal to $\frac{1}{2}$g and the length $l_n$ equal to 3/2g an efficiency $\eta$ of the fast mode compared with the slow mode of 0.97 is obtained, the efficiency of the fast mode being increased by a factor equal to 1.18 compared with the case in which l is equal to g, whilst the efficiency of the slow mode is reduced by a factor equal to 0.92. In the same way, when length $l_m$ is taken as equal to $\frac{3}{4}$g and the length $l_n$ equal to 5/4g, an efficiency of the fast mode compared with the slow mode of 0.85 is obtained, the efficiency of the fast mode being increased by 9% compared with the case in which l is equal to g, whilst the efficiency of the slow mode is only reduced by 2%.

On assuming operation frequencies and effective linear shunt impedances with virtually identical values for both modes, it is easy to see that with a given high frequency power, if the accelerator can accelerate in the slow mode heavy ions such that the ratio q/A exceeds the ratio $(q/A)_L$ at an energy $W_L$ per nucleon, in the fast mode the acclerator could accelerate at energy $W_R$ equal to $4W_L$ per nucleon, light ions such that the ratio (q/A) exceeds the ratio $(q/A)_R$, the latter ratio being defined by the relationship $(q/A)_R=4/\eta$. It is pointed out that q represents the ion charge and A its mass.

Figure 1:
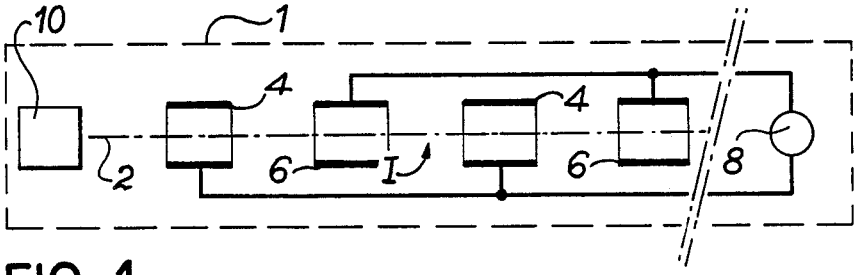
FIG. 1 already described, is a circuit diagram of a linear ion accelerator according to the prior art.
Figure 2A:
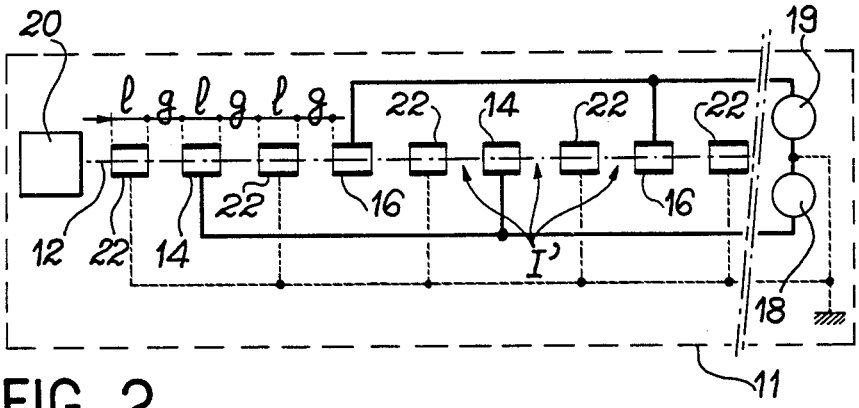
Figure 2B:
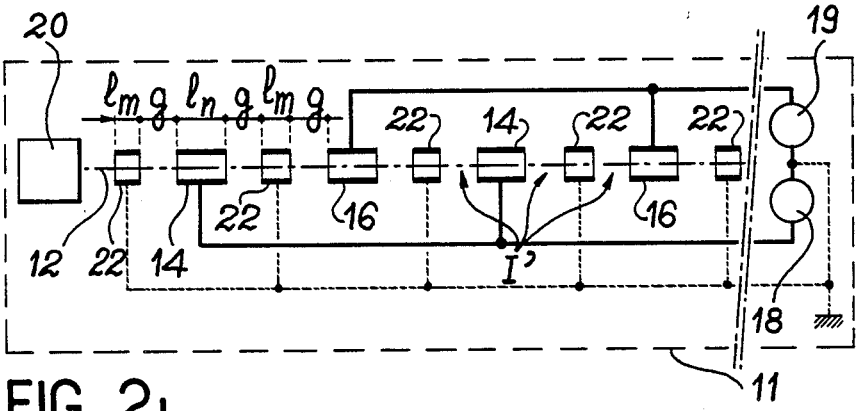
Figure 3A:
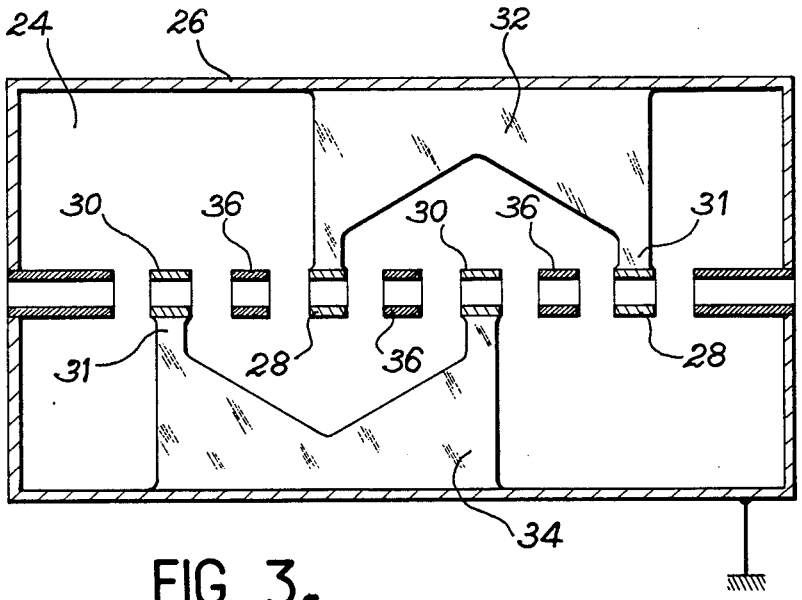
Figure 3B:
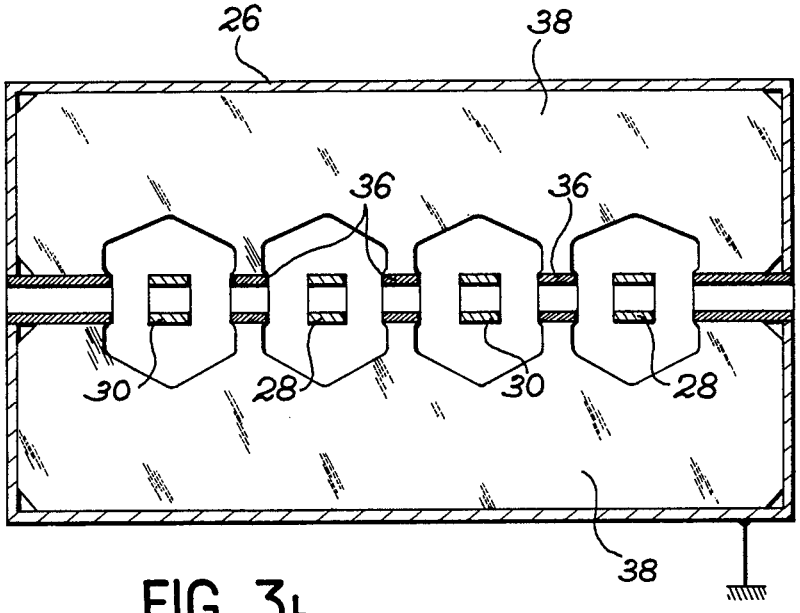

FIGS. 3*a* and 3*b* show a practical embodiment of a linear accelerator according to the invention. This accelerator comprises a cavity 24 functioning on a transverse mode and located within a conductive cylindrical envelope 26. Cavity 24 alternately contains drift tubes 28 and 30 supported, via tongues such as 31, respectively by two plates 32 and 34 (FIG. 3*a*). These radially disposed plates 32, 34 are diametrically opposite and electrically joined to envelope 26. The assembly constitutes a resonator cavity in which the drift tubes 28 are raised to approximately the same instantaneous alternating potential V and the tubes 30 to approximately the same potential, i.e. either V or −V.

Supplementary tubes 36 are interposed between drift tubes 28 and 30. Tubes 36 are carried by a plate 38 (FIG. 3*b*), disposed in a plane perpendicular to that containing plates 32, 34 and electrically connected to envelope 26. Plate 38 is raised to earth potential.

FIG. 4 shows an electrical diagram corresponding to the construction described relative to FIGS. 3*a* and 3*b*. The chokes L correspond to the inductance due to the magnetic field flux in each of the quadrants of cavity 26, said quadrants being defined by plates 32, 34 and 38. The capacitors C represent capacitances distributed on the one hand between plate 32 and earth, and on the other hand between plate 34 and earth. Capacitor C′ represents the capacitance distributed between plates 32 and 34.

The electrical diagram shown in FIG. 4 can be considered as formed from two circuits a and b, tuned to the same frequency and coupled by capacitor C′.

The two operating modes of the linear accelerator correspond on one case (the slow mode) to the resonance of the coil L parallel to capacitor C/2, the potentials V being of the same sign, and the other (the fast mode) to the resonance of coil L in parallel with capacitor C′ +C/2, the potentials V being opposed relative to earth.

The presence of capacitor C′ makes it possible to choose the desired operating mode, because the resonant frequency $F_R$ of the first mode is lower than the resonant frequency $F_L$ of the second mode. The power is supplied by a single high frequency generator, which can be tuned to frequencies $F_R$ and $F_L$.

The ratio of these two resonant frequencies $F_L/F_R$ is equal to $\sqrt{1+2C'/C}$, so that to a certain extent this ratio can be modified by acting on the value of C′, i.e. by acting e.g. on the size of the plates supporting the drift tubes. This makes it possible to optimize the linear accelerator according to the invention for two groups of ions, whereof the mass charge ratios are below 4. For example, with such an accelerator it is possible to accelerate protons and deuterons, which can be of particular interest in connection with medical uses.

Electrical measurements carried out on the aforementioned linear accelerator and on a prior art linear accelerator having the same external dimensions, have revealed that for a cavity operating on two modes according to the invention, its effective linear shunt impedance, operating on the slow mode, is slightly higher than that of a cavity operating on a single mode, for identical operating frequencies and coefficients $\beta_L$ ($\beta_L$ being close to 0.12). In the fast mode, the effective linear shunt impedance obtained with the two-mode cavity is approximately twice as high as that obtained with the single-mode cavity for the same coefficient $\beta_R$ ($\beta_R$ being close to 0.21).

The good behaviour of the effective linear shunt impedance for high values of $\beta$ ($\beta$ higher than 0.15) is due to the fact that the linear accelerator according to the invention has twice as many drift tubes and the acceleration gaps are twice as short as in conventional linear accelerators.

The practical embodiment described hereinbefore corresponds to a linear accelerator, whose cavity operates in the transverse mode. Obviously, any other practical embodiment can be envisaged.

According to the invention, the structure described hereinbefore can be advantageously used in the linear accelerator having an input stage using the focusing of an ion beam by quadripole at high frequency.

It is known that for low values of $\beta$ (below 0.05), focusing is difficult to carry out by conventional means. However, if the high energy stages use cavities operating on two modes, in accordance with the present invention, it is necessary that the input stage can operate on two corresponding resonant frequencies ($F_R$ and $F_L$) and that, on each of these frequencies, said stage supplies an ion beam having different coefficients $\beta$ for each of these two frequencies, corresponding to the values accepted by the following stage.

Although, for example, it is possible to obtain this result by using two different high frequency quadripoles, operating respectively at frequencies $F_L$ and $F_R$, it is nevertheless preferable for reasons of simplicity, economy and homogeneity of the accelerator, to construct said input stage in the form of a two-mode structure.

FIG. 5 shows two high frequency quadripole drift tubes 40*a*, 40*b*. According to the prior art, these drift tubes 40*a*, 40*b*, connected to the accelerator structure by means of rods 41, comprise in each case a central ring 42, on which are mounted two sets 44, 46 of two half-fingers, respectively 48 and 50. As these sets are arranged parallel to the axis 52 of the central ring 42, they are positioned on either side of the latter. Moreover, the half-fingers 48 of set 44 and the half-fingers 50 of set 46 are arranged symmetrically with respect to the axis of the ring, i.e. are diametrically opposite.

Moreover, in a linear accelerator using such drift tubes, two consecutive drift tubes, such as 40*a* and 40*b*, are so positioned relative to one another that the arrangement of the half-fingers of one of the two tubes, e.g. 40*b*, can be deduced from that of the half-fingers of the other tube, e.g. 40*a*, by a rotation by $\pi/2$, about the ring axis 52.

In conventional linear accelerators having high frequency quadripole drift tubes, the half-fingers of the two sets, i.e. the half-fingers 48, 50 corresponding respectively to sets 44 and 46 are arranged in an extension of one another (FIG. 5). Such a half-finger arrangement can be used when the accelerator is operating in the slow mode.

However, this does not apply when it operates in the fast mode. In particular, it is not possible to obtain an alternating gradient effect with respect to the electrical field.

To obviate this disadvantage, use is made according to the present invention and as shown in FIG. 6, for the two sets of half-fingers displaced relative to one another by an angle of $\pi/2$ and in particular the half-fingers 54 and 60 corresponding respectively to the two sets 56 and 58 form between them an angle of $\pi/2$.

According to the invention, this displacement by an angle of $\pi/2$ is effected for every other drift tube. It can be carried out either on the drift tubes 14, 16, raised respectively to potential V and potential $\pm$V, or to the supplementary drift tubes 22, raised to earth potential.

In FIG. 6, the staggered half-fingers are those of the supplementary drift tubes 22. For the other drift tubes, the half-fingers 48, 50 of the two sets 44, 46 are disposed, as in the prior art, in an extension of one another, in this case drift tubes 14, 16. The elements constituting the drift tubes, which remain unchanged compared with those of the prior art, carry the same references as those in FIG. 5.

It should be noted that such an arrangement of the half-fingers can be envisaged in conventional accelerators, i.e. not having supplementary drift tubes. This makes it possible to obtain a more intense focusing of the ion beam by doubling the spatial period of the focusing field, which e.g. makes it possible to accelerate a more intense beam for a given diameter.

The invention has been described in its application to the acceleration of ions. However, it is not limited to this application and can also be used for accelerating electrons, in which case the only changes involve modifications to the dimensions of the different components.

It is known that electrons become relativistic at relatively low energy levels. The shunt impedance of standing wave accelerators with drift tubes of a conventional nature then becomes very low. It is for this reason that it is conventional practice to use travelling wave accelerators operating in ultra-high frequencies for accelerating the electrons, although the corresponding techniques are relatively costly and are relatively difficult to perform.

The procedure proposed by the invention makes it possible to significantly increase the shunt impedance of standing wave electron accelerators having drift tubes, which makes it possible to give more favourable consideration to the construction and use of very "rustic" machines, operating in a meter wave range, and used e.g. for industrial sterilization.

Moreover, the invention can be used in structures other than the Wideroe-type structure. For example, the invention is of interest in connection with coupled reentrant cavity accelerators (using holes or loops), the addition of the supplementary drift tubes making it possible to reduce the diameter of the drift tubes.

The advantage is probably less than for a Wideroe accelerator or a T.E. cavity accelerator like that described, but this solution can be of interest in the case of high values of $\beta$, particularly for electrons.

Finally, an Alvarez-type accelerator can be considered as a series of reentrant cavities, which are stacked on one another and in which the currents on the two faces of adjacent walls are equal and opposite, which makes it possible to eliminate these walls.

It is known that the Alvarez accelerator shunt impedance drops very rapidly as from relatively low values of $\beta$ (0.1 to 0.15), because the tubes then become very thick and very long, so that the current in the centre of each tube is very high.

The shunt impedance can definitely be significantly improved by adding supplementary tubes.

The supplementary drift tubes are not necessarily connected to earth. However, for practical reasons, they can only be connected to the envelope by a choke, which is either very low, in which case the supplementary tube is substantially at the potential of the envelope, or high, in which case the supplementary tube is raised to an intermediate potential between those of the ends of adjacent drift tubes. These chokes are in practice constituted by the conductive supports of supplementary drift tubes. The case of an accelerator operating on mode $\pi(L=\beta\lambda/2)$, and more specifically a Wideroe-type accelerator has been given for information purposes.

The number of intermediate drift tubes is not limited to one, but in principle there can be a random number thereof in order to improve the shunt impedance. An uneven number is used, when it is wished to retain the possibility of operation on two modes, namely fast and slow, as will be shown hereinafter.

In a prior art drift tube standing wave linear accelerator, a cell of length $L=\beta\lambda/2$ or $L=\beta\lambda$ as a function of whether the direction of the longitudinal component of the field in question is reversed at a given time from one cell to the next, has a single accelerating gap located between two half-drift tubes 4, 6, as shown in FIG. *7a*.

According to the invention, the addition of an intermediate drift tube 22 subdivides the acceleration gap into two half-cells, as shown in FIG. *7b*. This makes it possible to reduce the dimensions and therefore the capacitances of the drift tubes, so that the shunt impedance can be increased.

The number of elements into which the acceleration gap can be subdivided is obviously not limited to two. For example, it is possible to introduce two intermediate drift tubes 22, as shown in FIG. *7c*. The conductive supports connecting them to the walls must be arranged in such a way as to adequately distribute the field between the three thus defined acceleration gaps.

If it is wished to retain the possibility offered by the subdivision of a cell into two half-cells, permitting operation in two modes, it is possible to have an operating pattern such that the instantaneous values of the longitudinal component of the field are opposed in the two half-cells. The number of intermediate drift tubes must be uneven, as is shown in FIG. *7d*, where there are three intermediate tubes 22.

What is claimed is:

1. A linear charged particle accelerator comprising, a conductive envelope, first and second alternatively arranged drift tubes disposed in said envelope, said drift tubes defining between them acceleration gaps, the lengths of such gaps having values which cause in two successive gaps the electrical field's longitudinal component to have an identical modulus, and at least one supplementary drift tube disposed in each gap and arranged in the gap between a first and a second adjacent tube and disposed in and electrically connected to the envelope, means for driving said supplementary drift tubes with a signal which allows proper operation with a reduced diameter for said first and second drift tubes and increases the effective linear shunt impedance of the accelerator structure.

2. A linear accelerator according to claim 1, wherein said accelerator is of the Wideroe linear accelerator type, said supplementary drift tubes being connected to ground, said first drift tubes being connected to an instantaneous potential source V, and said second drift tubes being connected to an instantaneous potential source V′ or to an instantaneous potential source −V′, so as to permit two operating modes, a fast operating mode for accelerating first ions having a first weight and a slow operating mode for accelerating second ions having a weight greater than said first weight.

3. A linear accelerator according to claim 2, wherein said first, second and supplementary drift tubes have a length equal to the length of the gap separating a supplementary drift tube and another drift tube.

4. A linear accelerator according to claim 2, wherein the supplementary drift tubes have a length which is less than the length of the gap separating a supplementary drift tube and another drift tube, and wherein the other drift tubes have a length which is greater than the length of said gap.

5. A linear accelerator comprising an input stage using the focusing of an ion beam by high frequency quadripole, having drift tubes in the input stage which comprise a central ring on which are mounted, parallel to the ring axis, two sets of two fingers, one set being disposed on one side of the ring and the other set on the opposite side of said ring the fingers of each set being arranged diametrically opposite with respect to the ring axis, the fingers of one set being displaced from the fingers of the other set by an angle $\pi/2$, for one out of every two drift tubes, and the fingers of one set being positioned in the extension of the fingers of the other set for the other drift tubes.

6. A linear accelerator according to claim 1, comprising an input stage using the focusing of an ion beam by high frequency quadripole, wherein said first, second and supplementary drift tubes in the input stage comprise a central ring on which are mounted, parallel to the ring axis, two sets of two fingers, one set being disposed on one side of the ring and the other set on the opposite side of said ring, the fingers of each set being arranged diametrically opposite with respect to the ring axis, the fingers of one set being displaced from the fingers of the other set by an angle $\pi/2$, for said supplementary drift tubes and the fingers of one set being positioned in the extension of the fingers of the other set for said first and second drift tubes.

* * * * *